US005912071A

United States Patent [19]

Takeshita et al.

[11] Patent Number: 5,912,071

[45] Date of Patent: Jun. 15, 1999

[54] RECORDING MEDIUM AND METHOD FOR ITS PRODUCTION

[75] Inventors: Isamu Takeshita; Takuya Nakao; Nobuyuki Yokota, all of Yokohama, Japan

[73] Assignee: Asahi Glass Company Ltd., Tokyo, Japan

[21] Appl. No.: 08/839,026

[22] Filed: Apr. 23, 1997

[30] Foreign Application Priority Data

Apr. 24, 1996 [JP] Japan ..... 8-102434
Jul. 10, 1996 [JP] Japan ..... 8-180967

[51] Int. Cl.[6] ..... B41M 5/00

[52] U.S. Cl. ..... 428/304.4; 156/235; 427/146; 427/180; 427/190; 427/195; 427/356; 427/358; 428/195; 428/206; 428/211; 428/323; 428/327; 428/328

[58] Field of Search ..... 427/146, 180, 427/190, 195, 356, 358; 428/195, 206, 211, 304.4, 323, 327, 328; 156/235; 347/105

[56] References Cited

FOREIGN PATENT DOCUMENTS 2 085 492 4/1982 United Kingdom .

OTHER PUBLICATIONS

Patent Abstracts of Japan, vol. 10, No. 218 (M–503), Jul. 30, 1986, JP–A–61 057380, Mar. 24, 1986.

*Primary Examiner*—Bruce H. Hess
*Attorney, Agent, or Firm*—Oblon, Spivak, McClelland, Maier & Neustadt, P.C.

[57] ABSTRACT

A recording medium comprising a substrate and a porous layer formed on the substrate, said porous layer comprising alumina hydrate particles and nonionic or cationic water-insoluble resin particles having an average particle size of from 0.005 to 0.1 $\mu$m.

18 Claims, No Drawings

RECORDING MEDIUM AND METHOD FOR ITS PRODUCTION

The present invention relates to a recording medium, particularly a recording medium for ink jet.

In recent years, for presentation at various academic meetings or seminars, overhead projectors have been mainly used instead of conventional slide projectors. Also in the field of printing, transparent printed products have been required for various publications or for the purpose of wrapping. For printing on such transparent films, a special care is required with respect to the printing speed and drying, as compared with printing on usual paper, since the substrate films do not have absorptivity by themselves.

JP-A-2-276670 and JP-A-4-320877, for example, disclose that a recording sheet having an ink-receiving layer made of alumina hydrate, formed on a substrate having no absorptivity, is useful as a recording medium. This recording sheet is the one having a layer made of porous alumina hydrate which absorbs and fixes mainly the dye in the ink, formed on a transparent substrate such as a polyethylene terephthalate substrate. This porous alumina hydrate layer is formed by coating on the substrate a coating fluid comprising an alumina sol made of boehmite crystal particles and a binder of polyvinyl alcohol type, followed by drying.

However, the coating fluid comprising an alumina sol and a polyvinyl alcohol type binder had a difficulty that the viscosity tended to increase as time passed, and particularly when it was a coating fluid having a high solid content concentration, the handling efficiency was poor, and the coating operation tended to be difficult. If the coating fluid was maintained at a high temperature to prevent the increase of the viscosity of the coating fluid, a geled product and an agglomerated product tended to accumulate due to evaporation on a part of a the coater head of the coating machine, and such accumulated products caused defects on the appearance of the recording sheet, especially in the case of a continuous coating operation.

Such an ink-receiving layer made of alumina hydrate, can be formed on a paper substrate. In particular, by using a method such as cast coating or calendering, it is possible to obtain a glossy paper having a smooth surface and high gloss. However, to increase the ink absorptivity and color reproducibility of such a glossy paper, the thickness of the adsorbing layer is required to be at least 20 μm, and no adequate commercialization has been possible in the market for glossy paper where a low price is required. Namely, the ink transfer speed between the ink-receiving layer and the paper substrate is so slow that it has been required to absorb majority of the ink solely by the ink-receiving layer.

Under these circumstances, it is an object of the present invention to provide a recording medium having an excellent image quality, by using an alumina coating fluid, which is stable with time and whereby a continuous operation is possible.

Further, it is an object of the present invention to provide a glossy paper which has a high ink transfer speed between the ink-receiving layer and the paper substrate and which has a high ink absorptivity, a high color density and a high quality, even when the thickness of the ink-receiving layer is not more than 15 μm, more preferably not more than 10 μm.

The present invention provides a recording medium comprising a substrate and a porous layer formed on the substrate, said porous layer comprising alumina hydrate particles and nonionic or cationic water-insoluble resin particles having an average particle size of from 0.005 to 0.1 μm.

Now, the present invention will be described in detail with reference to the preferred embodiments.

In the present invention, the alumina hydrate particles may be any alumina hydrate particles so long as they are capable of effectively absorb the solvent, etc. in the ink, when they are coated to form a porous layer on the surface of a recording medium. However, boehmite (AlOOH) is particularly preferred. As their secondary agglomerated particle size, a size of from 100 to 200 nm is preferred with a view to forming a transparent porous alumina hydrate layer and with a view to obtaining a recorded product having a high color density.

In the present invention, the alumina hydrate particles in the porous layer are preferably formed from an alumina sol, and it is particularly preferred that the sol particles are made of boehmite. Further, the nonionic or cationic water-insoluble resin particles having an average particle size of from 0.005 to 0.1 μm are preferably mixed to the above-mentioned alumina sol in the form of an aqueous dispersion. Such a mixed fluid is excellent in dispersibility and has a low viscosity. When such a mixed fluid is coated on a substrate, a highly transparent porous layer can be formed. Here, the resin particles serve as a binder.

Otherwise, the above mixed fluid may be agglomerated to form agglomerated particles, and such agglomerated particles may be coated on a substrate together with an organic binder separate from the above-mentioned resin particles. By forming the porous layer by agglomerated particles, the ink transfer speed from the porous layer to the substrate can be increased, and when paper is used as a substrate, it is possible to obtain a recording medium which has a good ink absorptivity and a high dye-fixing property, even when the thickness of the coated layer is not more than 15 μm. Further, the thickness of the coated layer may be made to be not more than 10 μm. The paper to be used as a substrate here, is required to have ink absorptivity, and woodfree paper for printing paper, high quality foam paper for information paper, PPC or a paper having an ink absorptivity equal to such paper, may preferably be used.

When agglomerated particles are to be formed, the mixed fluid of the alumina sol and the dispersion of the water-insoluble resin particles, is preferably rapidly dried by spray drying the agglomerated particles obtained by rapid drying preferably have an average particle size of from 1 to 20 μm. If the average particle size is less than 1 μm, the ink transfer speed of the porous layer to the paper substrate tends to be slow, and the ink absorptivity of the recording medium tends to be inadequate when the thickness of the porous layer is made thin. Further, if the average particle size exceeds 20 μm, irregularities tend to be formed on the surface of the recording medium, whereby the gloss tends to be low, such being undesirable. More preferably, the average particles size is from 1 to 15 μm.

For the spray drying, a spray dryer is used. In order to bring the particle size of the agglomerated particles within the above-mentioned range, it is preferred to use a spray dryer of pressurized two fluid nozzle system.

The agglomerated particles will then be dispersed in water. Here, according to the present invention, the agglomerated particles themselves have water resistance, and accordingly, the agglomerated particles can be dispersed in water while maintaining the agglomerated state. Further, an organic binder is added to this aqueous dispersion to obtain a coating fluid.

The above organic binder may be a water-soluble polymer such polyvinyl alcohol or its modified product, starch or its modified product, SBR latex, NBR latex, carboxycellulose or polyvinyl pyrrolidone. The organic binder is used preferably in an amount of from 5 to 50 wt % of the alumina hydrate particles form in the agglomerated particles contained in the coating fluid. If the amount of the binder is less than 5 wt %, the layer strength tends to be inadequate. On the other hand, if it exceeds 50 wt %, the ink absorptivity or the adsorptibity of a dye tends to be inadequate.

The above-mentioned recording medium using paper as the substrate, is preferably used as a glossy paper, and the 60° specular gloss of the surface of the porous layer is preferably at least 30%, as stipulated in JIS Z8741. More preferably, the 60° specular gloss is at least 40%.

A method for obtaining such a glossy paper preferably comprises coating the above-mentioned coating fluid on a substrate surface, then drying it until the water content in the coated layer will be preferably from 100 to 450 wt % relative to the solid content, then pressing a die having a smooth surface heated to a temperature of from 50 to 150° C. on the coated layer with a linear load of from 2 to 50 kg/cm, drying the coated layer and then releasing the die.

The above-mentioned pressing of the die on the coated layer can be carried out not only by a batch system but also by a continuous system using a rotary roll as a die having a smooth surface, or coating of the coating fluid on the substrate and pressing the die can be carried out continuously as a continuous operation.

Otherwise, the above glossy paper may also be obtained by coating the coating fluid on a smooth surface of a die, pressing a substrate against the coated layer, followed by drying to form an alumina hydrate layer and then releasing the die to transfer the alumina hydrate layer from the die to the substrate.

As the material of the die, a plastic such as polyethylene terephthalate (hereinafter referred to as PET) or polycarbonate, or a metal, may be employed without any particular restriction.

In the present invention, the nonionic or cationic water-insoluble resin particles having an average particle size of from 0.005 to 0.1 μm are preferably in an amount of from 2 to 50 wt %, as calculated as a solid content relative to the alumina hydrate particles. If they exceed 50 wt %, they tend to impair the ink absorptivity of the porous layer, such being undesirable. On the other hand, if they are less than 2 wt %, the mechanical strength tends to be inadequate when they are used as a binder, and in a case where agglomerated particles are to be formed, when agglomerated particles are dispersed in water, the agglomerated state of the agglomerated particles can hardly be maintained, and when the thickness of the porous layer is made thin, the ink absorptivity of the recording medium tends to be inadequate, such being undesirable. Especially when they are used as a binder, they are preferably in an amount of from 5 to 50 wt %, and when agglomerated particles are to be formed, they are preferably in an amount of from 2 to 35 wt %.

The resin particles in the present invention are required to be nonionic resin particles having no electrical charge on their surface or cationic resin particles having a positive charge on their surface. Particularly preferred are cationic resin particles. Such nonionic or cationic resin particles will form a stable aqueous dispersion under the acidic condition of at most pH 8, preferably at most pH 6. In the present invention, particles made of a cationic acrylic polymer (in the present invention, the acrylic polymer includes a methacrylic polymer) is preferably employed. The cationic resin particles have groups such as amine or quaternary ammonium groups, and a positive electric charge is obtained by electrolytic dissociation of such groups. Among such cationic acrylic polymers, those having a molecular weight of at least 10,000 are preferred from the viewpoint of the water resistance and weather resistance of the alumina hydrate layer. In the case of an ionic acrylic polymer made of e.g. an acrylic acid salt, flocculation of the alumina hydrate tends to occur due to an electrostatic reason, whereby a stable coating fluid tends to be hardly obtainable. Further, in the case of a common nonionic acrylic polymer made of e.g. an acrylic acid ester such as an alkyl acrylate, the mechanical strength of the polymer itself may be sufficient, but the adhesion between the alumina hydrate layer and the substrate such as polyethylene terephthalate tends to be poor.

Particularly preferred are composite type resin particles having a core/shell structure from the viewpoint of the mechanical strength of the alumina hydrate layer and the adhesion to the substrate. The core portion is preferably made of a polymer having an acrylic acid ester such as an alkyl acrylate as polymer units, and the shell portion is preferably made of a polymer having, as polymer units, a cationic acrylic acid derivative such as an acrylic acid ester or an acrylic acid amide having a tertiary amino group of a quaternary amino group, such as N,N-dimethylaminoethyl acrylate or N,N-dimethylaminopropyl acrylamide. The resin particles are preferably used in the form of an aqueous dispersion of from 5 to 50 wt %.

In the present invention, the average particle size of the resin particles if from 0.005 to 0.1 μm. If the average particle size exceeds the above range, the alumina hydrate layer tends to be opaque, whereby the recording medium will not be transparent even if the substrate is transparent. Further, even in a case where the substrate is opaque, there will be a problem that it is impossible to obtain a high quality image not to impair the texture of the substrate. On the other hand, if the average particle size is smaller than the above range, when the resin particles are used as a binder, the mechanical strength tends to be inadequate. The average particle size of the resin particles is preferably from 0.008 to 0.05 μm.

In the present invention, to form a porous layer substantially from the alumina hydrate particles and the nonionic or cationic water-insoluble resin particle having an average particle size of from 0.005 to 0.1 μm, the pore structure preferably comprises pores having radii of from 1 to 20 nm. Further, the pore volume is preferably from 0.3 to 1.2 ml/g, whereby adequate absorptivity will be obtained, and the porous layer will be transparent. Here, if the substrate is transparent, a transparent recording medium will be obtained. Even when the substrate is opaque, it is possible to obtain an image of high quality without impairing the texture of the substrate. Further, the measurement of the pore size distribution in this specification was carried out by a nitrogen absorption/desorption method.

In addition to these physical properties, it is preferred that the average pore radius of the alumina hydrate layer is from 4.5 to 9.0 nm, and the volume of pores having radii within a range of the average pore radius ±1 nm, is preferably at least 50% of the total pore volume, particularly with a view of satisfying both the transparency and the fixing property of a dye.

In the present invention, the coating fluid using the nonionic or cationic water-insoluble resin particles having an average particle size of from 0.005 to 0.1 μm, as a binder and comprising the resin particles and the alumina hydrate particles, is maintained usually from 5 to 35° C. after its preparation. This coating fluid is stable with little change is viscosity with time. Accordingly, continuous coating for a long period of time is possible. Further, a binder or any other additive components may be incorporated, as the case requires to this coating fluid, in addition to the above resin particles.

With respect to the coating method, it is preferred to coat the above coating fluid on a substrate by means of e.g. a bar coater, a rod coater, a blade coater, a comma coater, a roll coater, a die coater, an air knife coater or a floating knife coater. The thickness of the coated layer may suitably be selected depending upon the specification of e.g. a printer, or the types and the amounts of the ink and the solvent to be used for recording.

In the present invention, the porous layer may be a single alumina hydrate layer. However, to improve the scratch resistance of the surface, a silica layer may be formed on the alumina hydrate layer. Further, in a case where the thickness of the porous layer is thin, a surface layer made of an alumina hydrate may be formed thereon to optimize the size of dots formed by ink jet printing. Here, the surface layer made of alumina hydrate may be the same or different from the alumina hydrate layer is the present invention. To the surface layer made of silica or alumina hydrate, a water repellent or hydrophilic substance may be incorporated, as the case requires.

The mechanism in the present invention, whereby the increase in viscosity of the mixed fluid comprising the alumina sol and the aqueous dispersion of the nonionic or cationic water-insoluble resin particles, is suppressed, and the fluid becomes stable, is not clearly understood. However, it is considered that the water-insoluble resin in the particle state interacts with the alumina sol, whereby the viscosity is suitably adjusted.

Further, the structure of the porous alumina hydrate layer obtainable by coating and drying the coating fluid composed essentially of the above mixed fluid, is not clearly understood. However, it is considered that by reducing the average particles size of the resin particles to a level smaller than the secondary agglomerated particle size of the alumina hydrate particles, a proper porous layer can be formed, and a transparent alumina hydrate layer can be obtained.

Further, in a case where a thin porous layer is formed on a paper substrate having ink absorptivity by means of the coating fluid comprising agglomerated particles formed from the above-mentioned mixed fluid, a porous layer having large pores can be obtained, whereby the ink transfer speed from the porous layer to the paper substrate will be increased.

On the other hand, the agglomerated particles are particles wherein alumina hydrate particles are uniformly dispersed. This is believed to be attributable to the high fixing property of a dye and excellent color reproducibility.

The recording medium of the present invention is particularly suitable for an ink jet printer.

Now, the present invention will be described in detail with reference to Examples and Comparative Examples. However, it should be understood that the present invention is by no means restricted to such specific Examples.

In the following Examples, the solid content concentration of the alumina sol is a concentration calculated based on the solid obtained by drying at 140° C. to a constant weight.

In Examples 3 to 5 and Comparative Examples 4 and 5, the gloss was measured at an angle of 60° by means of Gloss Meter 300A, manufactured by Nippon Denshoku K.K.

For evaluation of the water resistance of the dried agglomerated particles in Example 3 to 5 and Comparative Examples 4 and 5, the agglomerated particles were exposed to water, whereby the water resistance was evaluated by the proportion at which the agglomerated state of the agglomerated particles is maintained. Specifically, the agglomeration ratio as defined below was used as the standard for evaluation.

Into a 100 cc centrifugal separation tube, 2 g of dried agglomerated particles were put, and 50 g of water was further added, followed by stirring to disperse the agglomerated particles in water. This dispersion was subjected to centrifugal separation for 5 minutes at 2,000 rpm, whereupon the supernatant was removed, and the remaining precipitate was dried, whereupon the proportion of the weight of the dried precipitate to the weight of the initial dried agglomerated particles was represented by percentage, which was used as the agglomeration ratio. Namely, agglomeration ratio (%)=(weight of the precipitate/2)×100.

EXAMPLE 1

A precipitate obtained by hydrolyzing aluminum isopropoxide, was peptized to obtain an alumina sol containing 19 wt % of alumina hydrate particles having an average secondary agglomerated particle size of 170 nm. Then, to 500 g of this alumina sol, 95 g of an aqueous dispersion of cationic acrylic resin particles having a solid content concentration of 30 wt % (Acrit UW-129Ex, manufactured by Taisei Kako K.K., average particle size: 0.01 μm) was added and mixed by stirring to obtain a coating fluid. The viscosity of this coating fluid was 45 cps at 20° C., and no increase of the viscosity was observed after maintaining it for 12 hours. Then, this coating fluid was coated on a transparent polyethylene terephthalate film having a thickness of 100 μm by a bar coater and dried to obtain a transparent recording sheet having a porous alumina hydrate layer.

COMPARATIVE EXAMPLE 1

To 500 g of the same alumina sol as in Example 1, 71.3 g of an aqueous dispersion of an anionic acryl/urethane resin particles having a solid content concentration of 40 wt % (Acrit WEM-141, manufactured by Taisei Kako K.K., average particle size: 0.1 μm) was added and mixed by stirring. Immediately after completion of the addition, geled agglomerates precipitated, whereby no stable coating fluid was obtained.

COMPARATIVE EXAMPLE 2

To 500 g of the same alumina sol as in Example 1, 72.2 g of an aqueous dispersion of cationic acrylic resin particles having a solid content concentration of 39.5 wt % (Boncoat SFC-241, manufactured by Dainippon Ink Chemical Industry Co., Ltd., average particles size: 0.2 μm) was added and mixed by stirring to obtain a coating fluid. The viscosity of this coating fluid was 52.5 cps at 20° C. No substantial increase was observed in the viscosity after maintaining it for 8 hours, and the coating fluid was stable. Then, in the same manner as in Example 1, this coating fluid was coated on a transparent polyethylene terephthalate film having a thickness of 100 μm by a bar coater and dried to obtain a recording sheet having a porous alumina hydrate layer. This recording sheet was white and was not transparent.

EXAMPLE 2

A precipitate obtained by hydrolyzing aluminum isopropoxide was peptized to obtain an alumina sol containing 20 wt % of alumina hydrate particles having an average secondary agglomerated particle size of 190 nm. Then, to 600 g of this alumina sol, 120 g of the same aqueous dispersion of cationic acrylic resin particles as used in Example 1, was added and mixed by stirring to obtain a coating fluid. The viscosity of this coating fluid was 43 cps at 23° D. Then, this coating fluid was coated on a polyethylene terephthalate film having a thickness of 100 μm by a bar coater and dried to obtain a recording sheet having a porous alumina hydrate layer having a thickness of 30 μm.

This recording sheet was placed outdoors to carry out an exposure test by sunlight, wind and rain. Upon expiration of 3 months of exposure, the porous alumina hydrate layer was in the same form as immediately after drying, whereby no deterioration of the recording sheet was observed.

COMPARATIVE EXAMPLE 3

600 g of the same alumina sol as in Example 2 was heated to 55° C., and 11 wt %, based on the alumina hydrate particles, of polyvinyl alcohol (PVA-124, manufactured by Kuraray Corporation) was added and water was further added and mixed by stirring to obtain a coating fluid having a solid content concentration of 16.5 wt %. The viscosity of this coating fluid was 52 cps at 55° C. Using this coating fluid, a recording sheet having a porous alumina hydrate layer having a thickness of 30 μm was prepared in the same manner as in Example 2.

With respect to this recording sheet, the same exposure test as in Example 2 was carried out, whereby upon expiration of 1 month, cracks formed over the entire surface of the porous alumina hydrate layer, and upon expiration of 3 months of exposure, the alumina hydrate layer was peeled from the polyethylene terephthalate film.

EXAMPLE 3

To 100 parts by weight (solid content) of the same alumina sol as in Example 2, 5 parts by weight (solid content) of the same aqueous dispersion of cationic acrylic resin particles as in Example 1 was added, and water was further added to obtain a formulated fluid having a solid content concentration of 10 wt %. This formulated fluid was rapidly dried by means of a spray dryer of pressurized two fluid nozzle system (Papyrus GB22, manufactured by Yamoto Kagaku K.K.) to obtain dried agglomerated particles. Here, the particles size of the agglomerated particles was 6 μm, and the agglomeration ratio was 90%.

Then, 20 parts by weight of the agglomerated particles were added to 80 parts by weight of water with stirring and completely dispersed. Then, as a binder, polyvinyl alcohol (MA26GP, manufactured by Shin-Etsu Chemical Industry Co., Ltd.) was added in an amount of 10 wt % to the agglomerated particles, and water was further added to obtain a coating fluid having a solid content concentration of 16.5 wt %. This coating fluid was coated by a bar coater on a substrate made of woodfree paper having a weight of 157 g/m$^2$, so that the dried coated amount would be 8 g/m$^2$. The water content immediately after coating was 506 wt % to the solid content in the coated layer. This coated layer was dried to a water content of 300%.

To this coated layer, a die having a specular surface heated to 90° C. was pressed under a linear load of from 10 to 20 kg/cm for drying, and then the specular surface was peeled therefrom to obtain a coated paper. The thickness of the coating layer of this coated paper was 10 μm, and the 60° specular gloss was 42%.

EXAMPLE 4

Agglomerated particles having an average particle size of 6 μm and an agglomeration ratio of 94%, were obtained in the same manner as in Example 3 except that the amount of the aqueous dispersion of cationic acrylic resin particles was changed to 10 parts by weight (solid content). Using the agglomerated particles, a coated paper having a coating layer thickness of 10 μm and a 60° specular gloss of 40%, was prepared in the same manner as in Example 3.

EXAMPLE 5

A coating fluid having a solid content concentration of 16.5 wt % was prepared in the same manner as in Example 2 except that polyvinyl alcohol was added so that it would be 11 wt % to the agglomerated particles. This coating fluid was coated on a PET film having a thickness of 100 μm by a bar coater so that the dried coated amount would be 8 g/m$^2$. The water content immediately after coating the 506 wt % to the solid content in the coated layer. This coated layer was dried to a water content of 370 wt %.

On this coated surface, woodfree paper having a weight of 128 g/m$^2$ was placed in close contact therewith, followed by drying until the water content in the coated layer became at most 5 wt % to the solid content, and then the PET film was peeled. The coated layer was completely transferred to the paper, whereby a coated paper was obtained. The thickness of the coating layer of this coated paper was 10 μm, and the 60° specular gloss was 41%.

COMPARATIVE EXAMPLE 4

Agglomerated particles were prepared in the same manner as in Example 1 except that only the alumina sol was used without using the cationic acrylic resin and water was added so that the solid content concentration would be 10 wt %. The average particle size of the agglomerated particles was 6 μm, and the agglomeration ratio was 0%. Using the agglomerated particles, a coated paper having a coating layer thickness of 10 μm and a 60° specular gloss of 43% was prepared in the same manner as in Example 3.

COMPARATIVE EXAMPLE 5

Agglomerated particles were prepared in the same manner as in Example 4 except that the same dispersion as in Comparative Example 2 was used as the aqueous dispersion of the cationic acrylic resin particles. The average particle size of the agglomerated particles was 6 μm, and the agglomeration ratio was 54%. Using the agglomerated particles, a coated paper having a coating layer thickness of 10 μm and a 60° specular gloss of 42%, was prepared in the same manner as in Example 3.

On each of the coated papers obtained in Examples 3 to 5 and Comparative Examples 4 and 5, a test pattern was printed by means of an ink jet printer (MJ500C, manufactured by Seiko Epson K.K.). With respect to each printed sheet, the ink absorptivity and the degree of beading were relatively evaluated respectively with five grades of from 1 to 5 (1: worst, 5: best). Further, with respect to cyan and magenta, the color densities were measured by a color densitometer (SPM1002, manufactured by GRETAG). The results are shown in Table 1.

TABLE I

| | | | Color density | |
|---|---|---|---|---|
| Example No. | Absorptivity | Beading | Cyan | Magenta |
| Example 3 | 4 | 5 | 2.34 | 2.13 |
| Example 4 | 5 | 5 | 2.22 | 2.02 |
| Example 5 | 5 | 5 | 2.21 | 2.05 |

TABLE I-continued

| Example No. | Absorptivity | Beading | Color density | |
|---|---|---|---|---|
| | | | Cyan | Magenta |
| Comparative Example 4 | 1 | 1 | 2.10 | 1.99 |
| Comparative Example | 2 | 2 | 2.15 | 1.08 |

The recording medium of the present invention has high ink absorptivity and provides a record having a high color density and being excellent in water resistance.

Further, according to the present invention, it is possible to form a recording medium by an alumina sol coating fluid which is excellent in the stability with time and the viscosity of which is stable even when maintained for a long period of time, whereby handling efficiency and the coating operation, particularly the continuous coating operation, can be facilitated. Further, using a paper having ink absorptivity as the substrate, a glossy paper can be presented which has excellent ink absorptivity and adhesion even when the thickness of the coating layer is made thin. Accordingly, it is possible to present an inexpensive high quality glossy paper.

Further, especially when a cationic acrylic polymer is used as the binder resin particles, an effect for suppressing blotting of a dye in a recording ink, is observed.

What is claimed is:

1. A recording medium comprising a substrate and a porous layer formed on the substrate, said porous layer comprising alumina hydrate particles and nonionic or cationic water-insoluble resin particles having an average particle size of from 0.005 to 0.1 μm.

2. The recording medium according to claim 1, wherein the water-insoluble resin particles are made of a cationic acrylic polymer.

3. The recording medium according to claim 2, wherein the cationic acrylic polymer is composite type resin particles having a core/shell structure.

4. The recording medium according to claim 1, wherein the alumina hydrate particles are made of a boehmite.

5. The recording medium according to claim 1, wherein the water-insoluble resin particles are in an amount of from 2 to 50 wt % of the alumina hydrate particles.

6. The recording medium according to claim 1, which has a 60° specular gloss of at least 30% as stipulated in JIS Z8741.

7. The recording medium according to claim 6, wherein the substrate is paper, and the porous layer has a thickness of at most 15 μm.

8. The recording medium according to claim 1, wherein the porous layer consists substantially solely of alumina hydrate particles and nonionic or cationic water-insoluble resin particles having an average particle size of from 0.005 to 0.1 μm.

9. The recording medium according to claim 8, wherein the porous structure of the porous layer comprises pores having radii of from 1 to 20 nm and has a pore volume of from 0.3 to 1.2 ml/g.

10. The recording medium according to claim 9, wherein the average pore radius in the porous layer is from 4.5 to 9.0 nm, and the volume of the pores having radii of the average pore radius ±1 nm is at least 50% of the total pore volume.

11. A method for producing a recording medium which comprises coating on a substrate a coating fluid comprising an alumina sol and an aqueous dispersion of nonionic or cationic water-insoluble resin particles having an average particle size of from 0.005 to 0.1 μm to form a porous layer on said substrate comprising alumina hydrate particles and said nonionic or cationic water-insoluble resin particles having said average particles size.

12. The method for producing a recording medium according to claim 11, wherein the water-insoluble resin particles are made of a cationic acrylic polymer.

13. The method for producing a recording medium according to claim 11, wherein the sol particles of the alumina sol are made of a boehmite.

14. The method for producing a recording medium according to claim 11, wherein the coating fluid contains dry agglomerated particles obtained by rapidly drying a mixture of an alumina sol and nonionic or cationic water-insoluble resin particles.

15. The method for producing a recording medium according to claim 14, wherein the substrate is paper.

16. The method for producing a recording medium according to claim 14, wherein the average particle size of the dry agglomerated particles is from 1 to 20 μm.

17. The method for producing a recording medium according to claim 14, wherein the coating fluid is coated on the substrate to form a coating layer, a die having a smooth surface is pressed on the coating layer for drying, and the die is released after drying, to form a coating layer on the substrate.

18. The method for producing a recording medium according to claim 14, wherein the coating fluid is coated on a die having a smooth surface to form a coating layer on the soothe surface, the coating layer is brought in close contact with the substrate and dried, and then the smooth surface die is released to transfer the coating layer onto the substrate.

* * * * *